US007246721B2

(12) United States Patent
Pritchard

(10) Patent No.: US 7,246,721 B2
(45) Date of Patent: Jul. 24, 2007

(54) FLEXIBLE PACKAGES WITH LIQUID DISPENSING TAP AND METHODS OF MAKING THE SAME

(75) Inventor: Barry Pritchard, Nazareth, PA (US)

(73) Assignee: Fres-co Systems USA, Inc., Telford, PA (US)

( * ) Notice: Subject to any disclaimer, the term of this patent is extended or adjusted under 35 U.S.C. 154(b) by 521 days.

(21) Appl. No.: 10/806,510

(22) Filed: Mar. 23, 2004

(65) Prior Publication Data

US 2005/0211726 A1 Sep. 29, 2005

(51) Int. Cl.
*B65D 35/56* (2006.01)

(52) U.S. Cl. ..... 222/105; 222/92; 383/906

(58) Field of Classification Search ..... 222/105, 222/107, 92, 541.9, 549.1, 185.1, 95, 94, 222/513–517, 505, 402.23; 383/906, 80; 141/313, 316, 10, 114, 2, 8; 220/601, 613, 220/359

See application file for complete search history.

(56) References Cited

U.S. PATENT DOCUMENTS

| | | | | |
|---|---|---|---|---|
| 3,690,524 | A * | 9/1972 | Haberhauer | 222/573 |
| 3,696,969 | A | 10/1972 | De Van et al. | |
| 4,314,654 | A | 2/1982 | Gaubert | |
| 4,394,936 | A * | 7/1983 | Shavit | 222/107 |
| 4,416,395 | A | 11/1983 | Gaubert | |
| 4,429,810 | A | 2/1984 | Hampel et al. | |
| 4,452,378 | A | 6/1984 | Christine | |
| 4,512,136 | A * | 4/1985 | Christine | 53/410 |
| 4,598,529 | A | 7/1986 | Pongrass et al. | |
| 4,602,725 | A | 7/1986 | Malpas et al. | |
| 5,210,993 | A | 5/1993 | van Boxtel | |
| 5,237,799 | A | 8/1993 | van Boxtel | |
| 5,911,340 | A | 6/1999 | Uematsu | |
| 6,045,119 | A | 4/2000 | Erb | |
| 6,050,451 | A | 4/2000 | Hess, III et al. | |
| 6,131,767 | A | 10/2000 | Savage et al. | |
| 6,182,426 | B1 | 2/2001 | Pritchard | |
| 6,273,307 | B1 | 8/2001 | Gross et al. | |
| 6,439,429 | B1 | 8/2002 | Gross | |
| 6,446,845 | B1 | 9/2002 | Steiger | |
| 6,612,466 | B1 | 9/2003 | Malin | |
| 2002/0130138 | A1 * | 9/2002 | Crozet et al. | 222/94 |
| 2005/0109796 | A1 * | 5/2005 | Bourque et al. | 222/94 |

FOREIGN PATENT DOCUMENTS

| | | | | |
|---|---|---|---|---|
| EP | 1 106 515 | A1 | 6/2001 | |
| JP | 2002-347140 | * | 12/2002 | 222/107 |
| WO | WO 01/02283 | A1 | 1/2001 | |

OTHER PUBLICATIONS

European Search Report dated Jun. 15, 2005.

* cited by examiner

*Primary Examiner*—Lien M. Ngo
(74) *Attorney, Agent, or Firm*—Caesar, Rivise, Bernstein, Cohen & Pokotilow, Ltd.

(57) ABSTRACT

Flexible packages for holding and selectively dispensing a liquid therefrom and methods of making those packages. Each package is formed of a flexible material and includes a tap fitment having a generally boat shaped base section sealed between contiguous portions of the package. The fitment includes a valve to enable liquid within the package to be dispensed. The flexible package is arranged to be located within an outer carton, with a portion of the fitment extending out of the carton. The packages can be made on an automated form, fill and seal machine or can be made of precursor packages on an automated fill and seal machine.

12 Claims, 6 Drawing Sheets

FLEXIBLE PACKAGES WITH LIQUID DISPENSING TAP AND METHODS OF MAKING THE SAME

CROSS REFERENCE TO RELATED APPLICATIONS

"Not Applicable"

STATEMENT REGARDING FEDERALLY SPONSORED RESEARCH OR DEVELOPMENT

"Not Applicable"

INCORPORATION-BY-REFERENCE OF MATERIAL SUBMITTED ON A COMPACT DISK

"Not Applicable"

BACKGROUND OF THE INVENTION

1. Field of Invention

This invention relates to generally to flexible packaging and more particular to flexible packages including a tap for containing a liquid to enable the selected dispensing of the liquid and a method of making such packaging on automated machinery, e.g., a form, fill and seal machine, or a fill and seal machine.

2. Description of Related Art

Numerous patents disclose flexible packing for holding liquids and for dispensing the liquid through a fitment outlet or tap forming a portion of the package. For example, U.S. Pat. No. 4,429,810 (Hample et al.) discloses a pouch for containing wine, with the pouch including a dispensing valve fitment. U.S. Pat. No. 3,696,969 (De Van et al.), U.S. Pat. No. 4,314,654 (Gaubert), U.S. Pat. No. 4,416,395 (Gaubert), U.S. Pat. No. 4,602,725 (Malpas et al.), U.S. Pat. No. 6,131,767 (Savage et al.), and U.S. Pat No. 6,446,845 (Steiger) disclose dispensing taps for "bag in box" containers. Another tap for controlling liquid flow from a bag in a box arrangement is disclosed in International Application WO 01/02283A1.

U.S. Pat. No. 4,452,378 (Christine) discloses a gusseted bottom pouch for containing a liquid, with the pouch including a spout including cap for enabling the contents to drained from the pouch.

U.S. Pat. No. 5,911,340 (Uematsu) and 6,612,466 (Malin) disclose boat shaped spout assemblies for flexible packages. U.S. Pat. No. 6,050,451 (Hess III, et al.) and U.S. Pat. No. 6,273,307 (Gross et al.) disclose boat shaped valved fitments for flexible packages.

While the aforementioned packages with fitments for containing and dispensing liquids and the fitments for use in such packages may be generally suitable for their intended purposes, they suffer from one or more of the drawbacks, e.g., they are not particularly suitable for manufacture on a form, fill and seal machine, they are somewhat complex in construction and/or not particularly compact, and they do not enable control the flow rate of the liquid being dispensed.

U.S. Pat. No. 4,598,529 (Pongrass et al.) discloses a method and apparatus for forming, filling and sealing flexible plastic bags. However, the bags produced do not include taps for enabling the selective dispensing of the contents of the bag.

BRIEF SUMMARY OF THE INVENTION

This invention relates to flexible packages for holding and selectively dispensing a liquid therefrom and methods of making the packages on a form, fill and seal machine or on a fill and seal machine.

The package comprises a bag and a fitment including a tap. In accordance with one preferred aspect of this invention, the bag is formed of a flexible material having edge portions confronting each other to form a fitment-receiving space. The tap fitment comprises a base section and a tap section. The base section is generally boat-shaped and has a first longitudinal axis, an opposed pair of smooth and continuous sidewalls extending along opposite sides of the first longitudinal axis, and a flange including a peripheral recess extending outward from the base section. A first passageway extends through the base section and the flange along a second axis perpendicular to the first longitudinal axis. The base section is arranged to be located within the fitment-receiving space and fixedly secured to the contiguous edge portions of the bag thereat.

The tap section comprises a second passageway extending therethrough coaxial with the first passageway and a controllable dispensing portion. The controllable dispensing portion comprises a generally tubular member in fluid communication with the second passageway and extending along a third axis perpendicular to the second axis. The controllable dispensing portion has a spout located at one end of the third axis, a twist cap located at the opposite end of the third axis and a valve connected to the twist cap. The twist cap is arranged to be rotated about the third axis.

In accordance with another preferred aspect of this invention the package is in the form of a precursor package that is arranged to be filled and sealed to produce flexible packages for holding and selectively dispensing a liquid therefrom. Each precursor package comprises a pair of open bags interconnected by an intermediate section. Each of the bags comprises a respective tap fitment, a first panel and a second panel juxtaposed opposite each other and fixedly secured to each other along first portions of their periphery, but unsecured along second portions of their periphery, to form an open top. The tap fitment has a generally boat-shaped base section and a tap section. The base section is interposed and sealed between the first portions of the periphery of the panels.

In accordance with one preferred method aspect of this invention, the packages of this invention are formed of a flexible material by means of an automated form, fill and seal machine. The machine forms plural bags, each bag having the pair of edge portions confronting each other to form the fitment receiving space. The machine then locates the fitment so that its base is within the fitment receiving space, whereupon its sidewalls are fixedly secured to the contiguous edge portions of the bag at the fitment receiving space.

In accordance with another preferred method aspect of this invention flexible packages of this invention can be made by means of a form and fill machine utilizing the precursor packages of this invention. In such a case each of the precursor packages is arranged to provided to an automated fill and seal machine, wherein each of its bags is filled with the liquid through its open top and then sealed along the open top by the machine to enclose the liquid therein.

In accordance with yet another preferred method aspect of this invention, the precursor packages may not initially include fitments. In such a case the precursor packages include fitment receiving spaces, into which respective fitments can be inserted and sealed prior to introduction into the fill and seal machine.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF THE INVENTION

Figure 1:
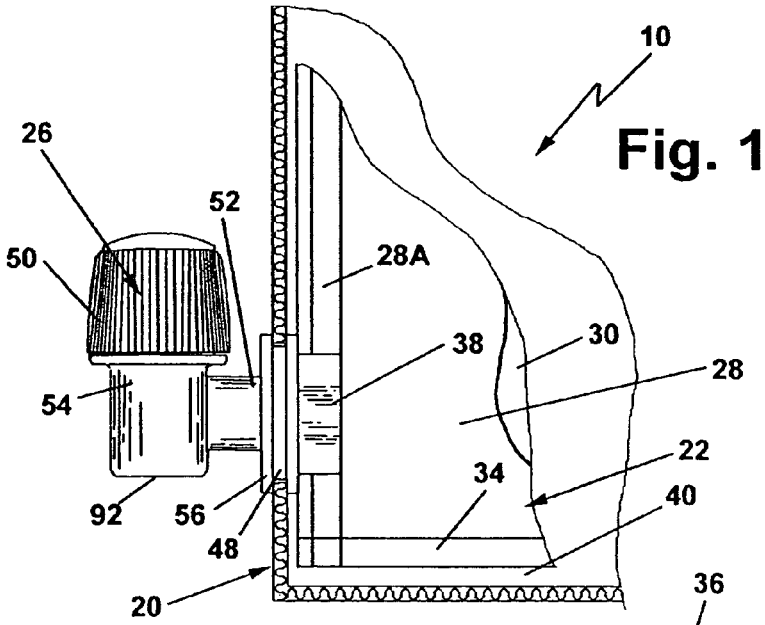
FIG. 1 is partial vertical sectional view of one exemplary embodiment of a package for holding and dispensing a liquid constructed in accordance with this invention.
Figure 2:
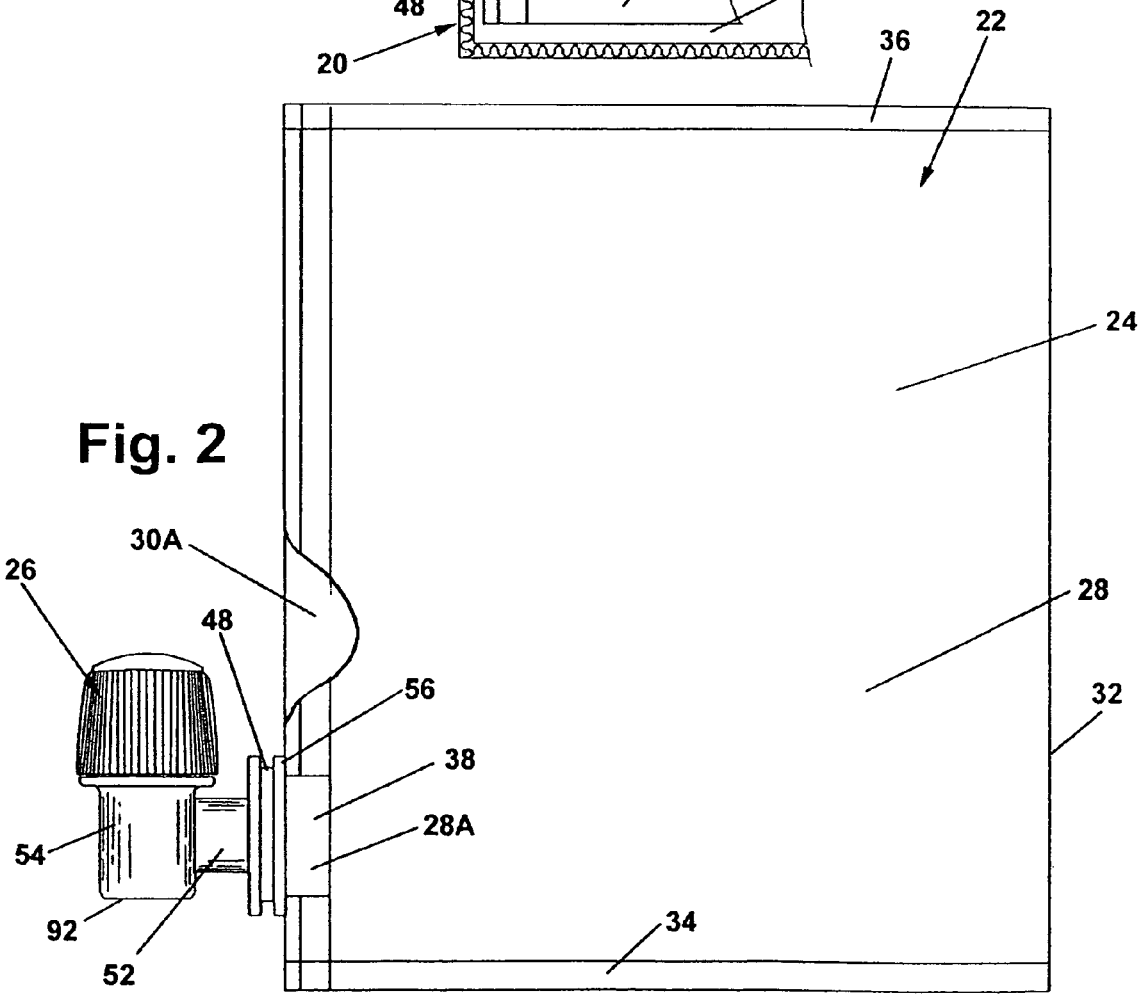
FIG. 2 is a top plan view of a flexible bag and tap fitment forming a portion of the package of FIG. 1.

In FIG. 1 there is shown at 10 one exemplary embodiment of a package for holding and dispensing a liquid, e.g., wine. The package basically comprises a carton 20 and a flexible package 22 constructed in accordance with this invention. The package 22 is best seen in FIG. 2 and basically comprises a flexible bag 24 and a tap fitment 26. The flexible package can be formed in various ways, to be described later. In the embodiment shown in FIG. 2 the bag 24 is formed of a pair of opposed panels 28 and 30 of any suitable conventional polymeric film. The panels are of a generally rectangular shape (but could be of other shapes, if desired) and are an integral unit formed from a web of polymeric film that has been oriented (e.g., folded) so that the two panels are juxtaposed opposite each other and connected on one side by a fold line fold line 32. The marginal edge portions of the panels 28 and 30 are heat sealed along a peripheral seal line 34 extending from one end of the fold line 32. Similarly, the marginal edge portions of the panels 28 and 30 are heat sealed along another peripheral seal line 36 extending from the opposite end of the fold line 32.

The remaining unsealed marginal edges of the panels 28 and 30 are designated by the reference numbers 28A and 30A and form a fitment receiving space. The fitment 26, whose details will be described later, is located in the fitment-receiving space between the marginal edges 28A and 30A and is heat sealed to them. In particular, as will be discussed in detail later, one side surface portion 38A (FIG. 5) of a base section 38 of the fitment 26 is heat sealed along its length to the contiguous portions of the edge 28A of the panel 28. In a similar manner, the opposite side surface portion 38B (FIG. 5) of the base section 38 is heat sealed along its length to the contiguous portions of the edge 30A of the panel 30. The remaining portions of the unsealed edges 28A and 30A are also heat sealed together. Thus, the entire periphery of the juxtaposed panels 28 and 30 is sealed to form bag having a hollow interior in which the liquid (not shown) to be dispensed is located. The filling of the bag with the liquid will be described later.

The base section 38 of the tap fitment 26 will also be described in detail later. Suffice it for now to state that it includes a passageway that is in fluid communication with the interior of the bag to enable the liquid contents of the bag to flow out of the bag under the selective manual control of a valve (to be described later) forming a portion of the tap fitment.

Once the bag 24 is filled with any desired liquid, e.g., wine, it can be disposed within the carton 20 to protect the bag and its contents. To that end, the bag may be inserted within the interior 40 of the carton 20 and the fitment 26 is pulled through a break-away or perforated opening 42 in the carton, so that portions of the carton contiguous with the periphery of the opening reside within a recess 48 (to be described later) in the tap fitment 26. This fixedly secures the tap fitment to the carton, with the operative portions of the tap fitment 26 being located outside the carton for access by the user to dispense some or all of the liquid contents of the bag.

Figure 3:
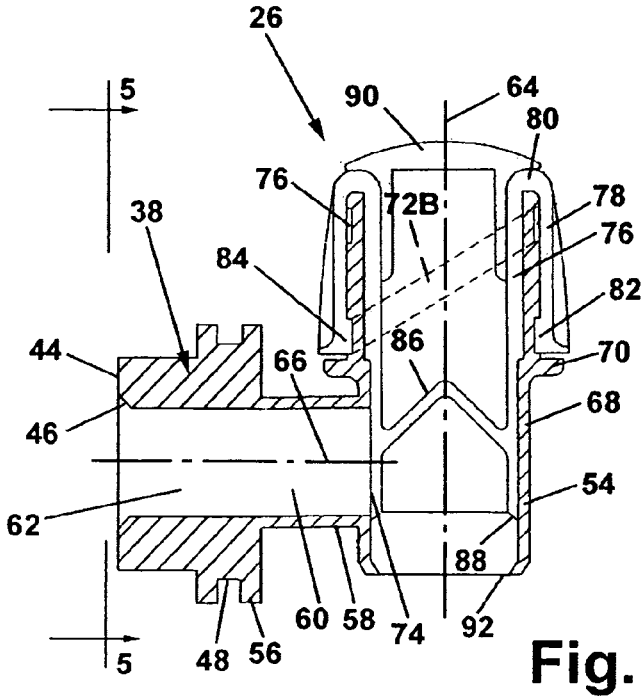
FIG. 3 is a sectional view of the fitment shown in FIG. 2, with the tap fitment being shown in its closed state.
Figure 5:
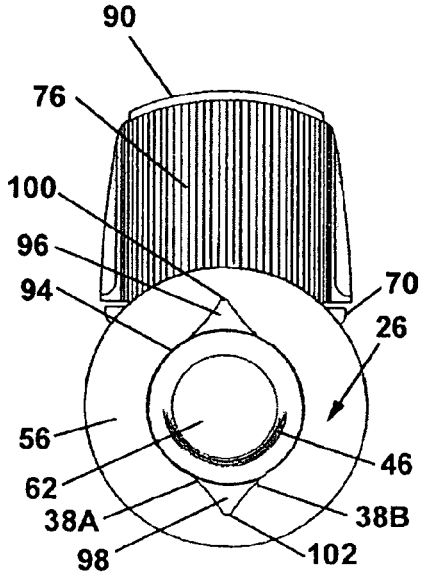
FIG. 5 is a rear end view of the tap fitment taken along line 5-5 of FIG. 3.
Figure 4:
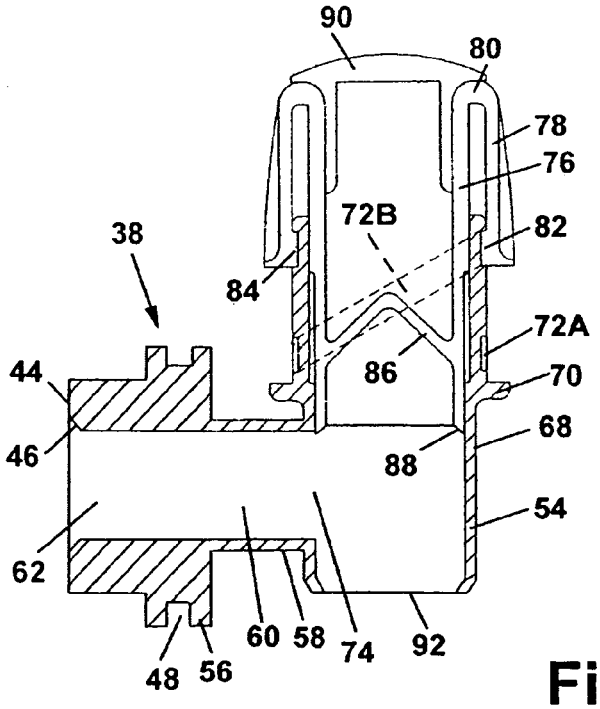
FIG. 4 is a sectional view of the fitment like that shown in FIG. 3, but with the tap fitment being shown in its opened state.

As best seen in FIGS. 3-5, the fitment 26 basically comprises the heretofore identified base section 38, and a tap section 50. The tap section 50 includes a tubular connection section 52 and a controllable dispensing section 54. The tubular connection section 52 basically constitutes a circular flange 56 (FIGS. 1-5) having the recess 48 in its periphery and a tube or barrel 58 (FIGS. 3 and 4) projecting perpendicularly to the top surface of the flange 56. The tubular connection section has a central passageway 60 (FIGS. 3 and 4) extending therethrough which is coaxial with a passageway 62 (FIGS. 3 and 4) extending through the base section 38. The passageway 62 opens to a chamfered surface 46 in the bottom wall 48 of the base section 38. Liquid from within the flexible package is thus enabled to flow into the axial aligned passageways 60 and 62. A valve (to be described later) in the controllable dispensing section serves to open or close those passageways to prevent or allow liquid to flow out of the package.

The controllable dispensing section 54 is similar in construction to the tap that disclosed in International Application WO 01/02283A1, whose disclosure is incorporated by reference herein, except that it extends along an axis 64 (FIG. 3) that is perpendicular to the axis 66 (FIG. 3) of the axially aligned passageways 62 and 60. The controllable dispensing section 54 basically comprises a tubular member 68 having a circular collar 70 protruding therefrom approximately midway along its length. A double start spiral groove 72A, 72B (FIG. 4) is located on the outer surface of the upper end of the tubular member 68. Each groove extends through approximately 180 degrees of the periphery of the tubular member. The grooves start near the collar 70 and terminate just short of the upper end of the tubular member 68. The innermost end of the passageway 60 in the barrel 58 forms an outlet 74.

A valve in the form of a plunger knob 76 (FIGS. 3 and 4) is located within the upper end of the tubular member 68. The plunger knob includes an outer skirt 78 and a radially transverse end wall 80. The skirt has two radially inward directed protrusions 82 and 84 on its inner face. The protrusions are slidably located in the grooves 72A and 72B, respectively. The plunger knob 76 includes an internal cylindrical portion that has a conically shaped inner wall 86 and terminates at a beveled sealing edge 88. A plug 90 closes off the hollow top of the plunger knob. The outer surface of the top portion of the plunger knob forms a cap which is arranged to be grasped to twist or turn the plunger knob about the axis 64. The outer surface of that cap is knurled (see FIG. 5) to facilitate the twisting/turning operation.

As will be appreciated by those skilled in the art, since the protrusions 82 and 84 of the plunger knob 76 are located within the spiral grooves 72A and 72B, respectively, when the plunger knob is twisted in one rotational direction it will move upward along the axis 64. When twisted in the opposite rotational direction the plunger knob will move downward along that axis.

The lower end of the tubular member 68 is in the form of an open spout 92. The lower end of the plunger knob contiguous with the sealing edge 88 is of a corresponding outside diameter to the inside diameter of the spout to close off or block the outlet 74 to the spout when the plunger knob has been rotated to the closed position as shown in FIG. 3. In such a case liquid is prevented from flowing out of the package by the closed valve. When the plunger knob is rotated to the open position, as shown in FIG. 4, the outlet 74 is unblocked so that the liquid from the package can flow through the aligned passageways 62 and 60 to the outlet 74 and from there out of the spout 92. Control of the rate of flow out of the package can be effected by rotating the plunger knob to any intermediate position between the fully open and the fully closed positions, whereupon the lower end of the plunger knob will only partially block the outlet 74, with the amount of blockage being established by the rotational position of the plunger knob. If desired, a valve seat (not shown) corresponding in shape to the beveled sealing edge 88 of the plunger knob may be provided in the tubular member 68 to cooperate with that sealing edge to ensure that when the valve is closed no liquid can leak out.

As can be seen in FIG. 5 the base section 38 of the fitment is generally "boat-shaped." For example, it can be seen that the base section 38 has a central portion 94, a first end portion 96 and a second end portion 98. The first end portion 96 projects outward from the central portion 94 and tapers to a first tip 100. The second end portion 98 projects outward from the central portion 94 diametrically opposite the first end portion 96 and tapers to a second tip 102. The base section 38, being longer than it is wide, thus has a longitudinal axis extending from the first tip 100 to the second tip 102. The base section 38 also includes the bottom wall 44, a smooth and continuous sidewall 38A extending on one side of the base section from the first tip 100 to the second tip 102 between the bottom wall and the flange, and another smooth and continuous sidewall 38B extending on the opposite side of the base section from the first tip 100 to the second tip 102 between the bottom wall and the flange 56. The smooth and continuous sidewalls 38A and 38B of the base section enable the base section to be heat sealed between the opposed peripheral portions of the panels 28 and 30, i.e., in the fitment receiving space, without any leakage of liquid through that interface when the bag is filled and sealed.

Figure 9:
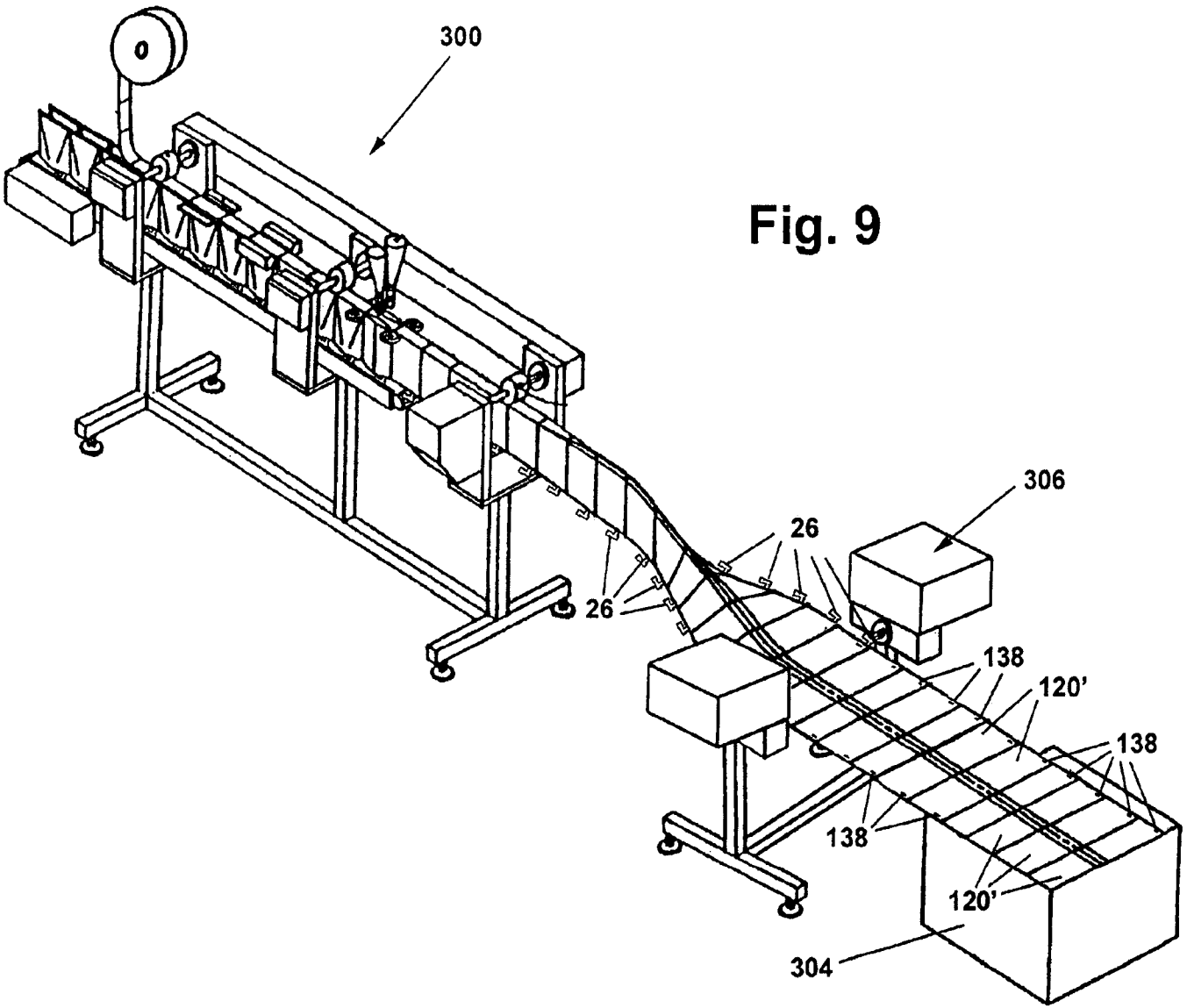
FIG. 9 is an isometric view of another automated apparatus or machine for filling and sealing saddle bag precursor packages, such packages not initially including tap fitments.

The flexible package 22 may be made by fabricating it from roll stock of flexible film, e.g., polymeric film, and securing the fitment to the bag using a conventional fill, form and seal machine, which has been configured to include a pair of heat sealing jaws to seal the fitment to the film. A vertical form, fill and seal machine for making and filling "stand-up" pouches having fitments is disclosed in my U.S. Pat. No. 6,182,426, whose disclosure is incorporated by reference herein. That machine can be readily modified to make the packages of this invention. FIG. 9 shows a vertical form, fill and seal machine 200 for making the packages 22 and is exemplary of many types of conventional form, fill and seal machines that can be used in accordance with this invention.

As is known, a vertical form, fill and seal machine, like that of FIG. 9, makes use of a web of polymeric film that is pulled downward intermittently in the machine by pairs of transverse (horizontal) sealing jaws. As the film web is drawn downward it is formed into a flat envelope by a forming collar or folder 202. In particular, the marginal side edges of the web of film are juxtaposed over each other to form a flat tube having a vertical fold line, like 32 in FIG. 2 located on the opposite side as the juxtaposed edges, like 28A and 30A in FIG. 2. The movement of the folded film envelope is stopped for a short period of time and the boat shaped base section 38 of a fitment 26 to be secured to the package is brought in between contiguous portions of those juxtaposed edges (i.e., into the fitment-receiving space) while the folded film envelope is stationary. A pair of corresponding shaped, vertically oriented, heat sealing jaws (not shown) are brought into engagement with the film envelope on each side of the fitment base section 38 to fixedly secure the fitment in place therebetween. Another pair of opposed, vertically oriented, heat sealing jaws (not shown) are brought into engagement with the contiguous and unsealed juxtaposed marginal edges of the film envelope for what will become the package to seal those edges and thereby form a film tube. The flattened film tube with the fitment 26 now secured to it is then moved downward by the operation of the pairs of transverse sealing jaws (not shown). These jaws create the top seal of a preceding package and the bottom seal of the next succeeding package.

In order to fill the packages as they are formed the machine includes a fill tube 204 that extends into the formed film tube and begins to fill the film tube once the bottom seal has been created. The filling of the film tube continues until the film tube has been moved down to the position wherein the transverse pairs of heating jaws seal its top end, while creating the bottom seal of the next successive package.

The top seal of the preceding package is spaced slightly below the bottom seal of the next succeeding package. A horizontally disposed knife blade (not shown) is introduced into the space between the pairs of jaws forming the top and bottom seals to separate the leading (now filled) package from the trailing package, i.e., to sever the film tube between the top seal of the preceding package and the bottom seal of the next succeeding package.

As will be appreciated by those skilled in the art, the subject package can also be made and filled on a horizontal form, fill and seal machine. In the interest of brevity such a machine is not shown herein.

Figure 6:
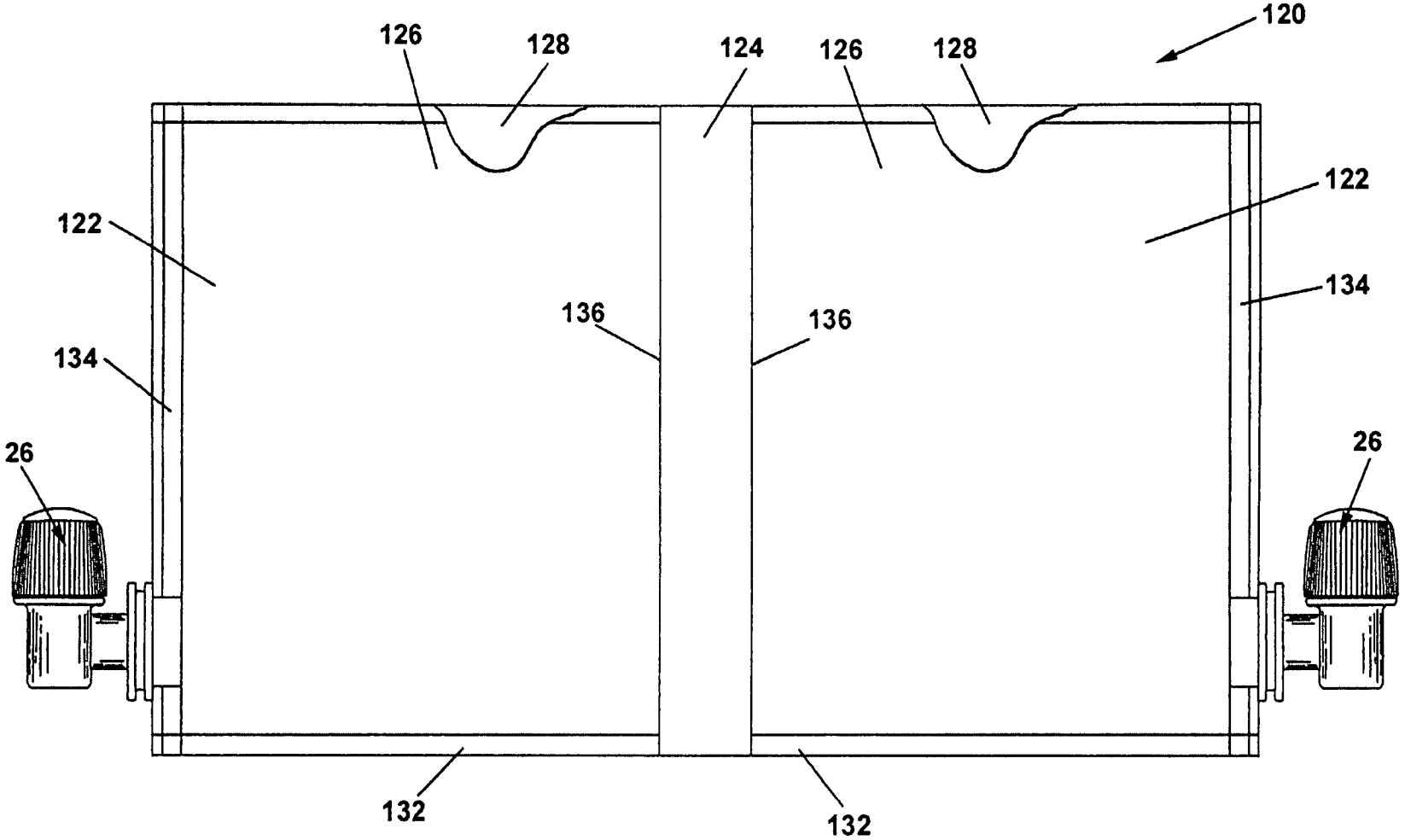
FIG. 6 is a top plan view of a precursor package in the form of a saddle bag arrangement with each bag including a tap fitment.
Figure 7:
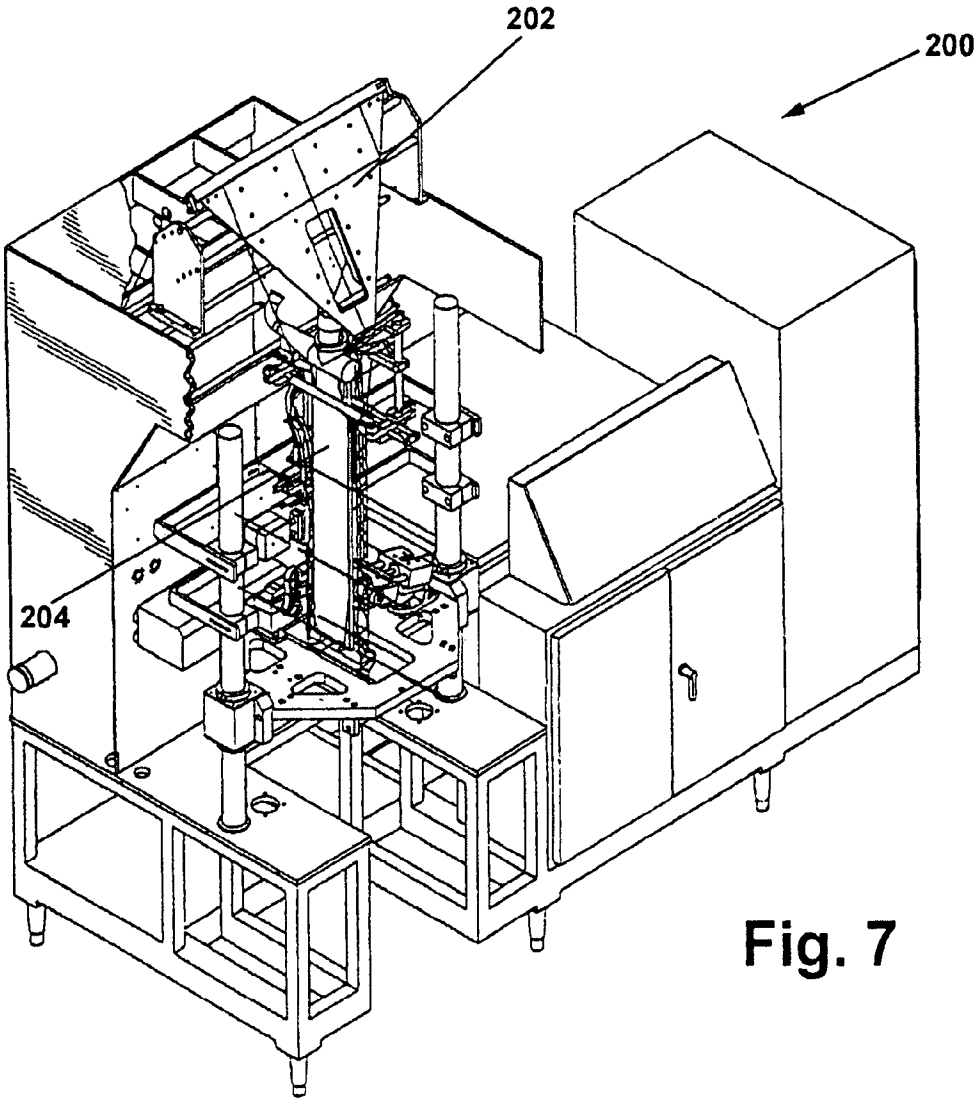
FIG. 7 is an isometric view of an automated apparatus or machine for forming, filling and sealing a series of flexible packages, each constructed like that shown in FIG. 2.

As best seen in FIG. 6, packages 22 of the subject invention can also be made by using a precursor package 120 in the form of a series of pairs of pouches or bags 122 each connected by an intermediate section 124 to form respective saddle-bag like arrangement. Such a saddle-bag arrangement is disclosed in U.S. Pat. No. 5,237,799, whose disclosure is incorporated by reference herein. That arrangement has been modified in accordance with this invention so that each bag 122 includes a tap fitment 26 like that disclosed above. To that end, as can be seen each of the bags 122 includes a top panel 126 and a bottom panel 128. The top panel 126 of each bag is sealed to the bottom panel 128 along its two side edges 130 and 132, respectively, and along its bottom edge 134. The fitment 26 is located and sealed in the bottom edge 134, like described above with respect to package 20. The bottom panel 128 is a unitary member whose mid-section forms the intermediate section 124 of the saddle bag arrangement. The top edge 136 of each of the bags 122 is open, i.e., it is not sealed along its interface with the underlying portion of the bottom panel 128 contiguous with the intermediate section 124.

Figure 8:
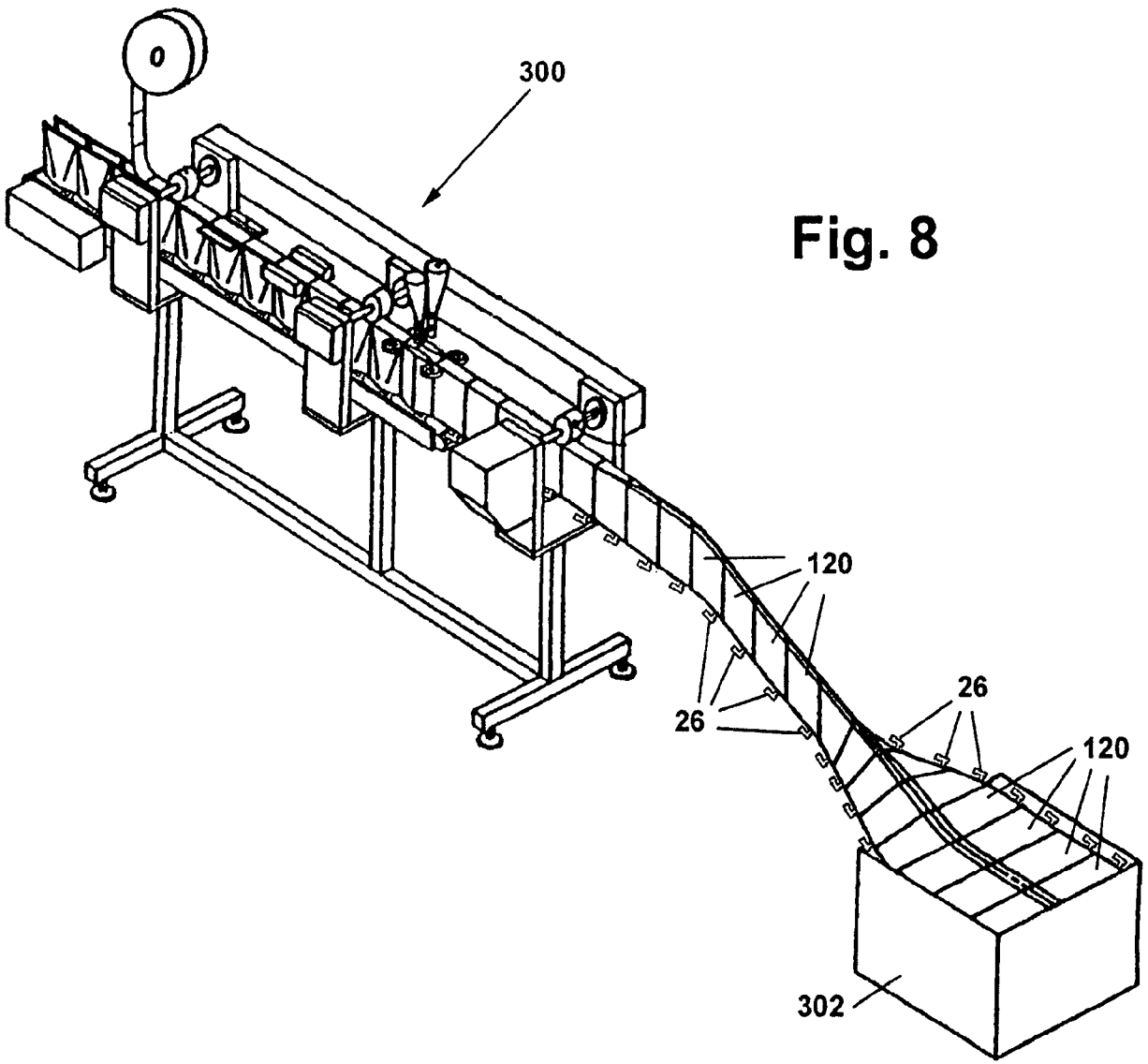
FIG. 8 is an isometric view of an automated apparatus or machine for filling and sealing the precursor (saddle type bag arrangement) package of FIG. 6.

A series of precursor package saddle bags 120 are arranged to be filled and sealed by a fill and seal machine 300, like shown in FIG. 8. That machine can be constructed in accordance with the teachings of U.S. Pat. No. 5,210,993, whose disclosure is also incorporated by reference herein. To that end a supply 302 in the form of a series of serially connected precursor saddle bag packages is provided and pulled into the machine 300, whereupon a filling valve enters into the open end 136 of each bag 122 and deposits the liquid therein. Once the liquid is deposited the open end of each bag is hermetically sealed by the machine 300 to complete the package.

Instead of using a supply of precursor package whose fitments are pre-applied, i.e., already sealed to the bags of the saddle bag arrangement, like that just described, packages of the subject invention can be made using precursors without any fitments. In such an arrangement the fitments 26 will be inserted into the bags of the precursor packages immediately before the packages are fed into the machine 300 for filling and sealing. Such an alternative arrangement is shown in FIG. 9. Thus, the supply 304 of precursor packages 120' will be constructed in the same manner as described above, except that they will not include any fitment in each bag of the saddle arrangement. In such a case, each bag 122 of the saddle arrangement 120' will have a portion of the peripheral edges of the top and bottom panels where the fixture would have been located in the embodiment shown in FIG. 8, left unsealed to form a fitment-receiving space 138. This space is represented by a series of short length lines in FIG. 9. It should be pointed out that while these lines appear in FIG. 9 to be in one of the panels of the bag, they are in fact at the interface of the peripheral edge of the bottom panel and the top panel.

The series of precursor packages 120' is then fed through a fitment insertion apparatus or station 306 where fitments are inserted into the fitment-receiving space 128 of each bag 122 of the precursor packages 120'. In particular, the boat shaped base section 38 of the fitment 26 is inserted into the fitment receiving space 138 and then sealed in place by a pair of correspondingly shaped heated sealing jaws (not shown) of the station 306. The series of packages 120' with the fitments sealed in place is then fed into the fill and seal machine 300, whereupon the bags of those packages are filled and sealed in the same manner as described with reference to FIG. 8.

While the invention has been described in detail and with reference to specific examples thereof, it will be apparent to one skilled in the art that various changes and modifications can be made therein without departing from the spirit and scope thereof.

What is claimed is:

1. A flexible package for holding and selectively dispensing a liquid therefrom, said package being arranged to be filled with the liquid and sealed on a machine, said package comprising a bag and a tap fitment, said bag being formed of a flexible material having edge portions confronting each other to form a fitment-receiving space, said tap fitment comprising a base section and a tap section, said base section being generally boat-shaped having a first longitudinal axis, an opposed pair of smooth and continuous sidewalls extending along opposite sides of said first longitudinal axis, a top wall, a flange including a peripheral recess extending outward from said top wall and a first passageway extending through said base section and said flange along a second axis perpendicular to said first longitudinal axis, said base section being arranged to be located within said fitment-receiving space and fixedly secured to the contiguous edge portions of the bag thereat, said tap section comprising a second passageway extending therethrough coaxial with said first passageway and a controllable dispensing portion comprising a generally tubular member in fluid communication with said second passageway and extending along a third axis perpendicular to said second axis, said controllable dispensing portion having an outlet located at one end of said third axis, a twist cap located at the opposite end of said third axis and a valve connected to said twist cap, said twist cap being arranged to be rotated about said third axis.

2. The package of claim 1 additionally comprising an outer carton, said package being arranged to be located within said carton, said carton having a wall including an opening, with portions of said wall contiguous with said opening being located within said flange recess.

3. The package of claim 1 wherein said generally boat-shaped base section comprises a central portion, a first end portion and a second end portion, said first end portion projecting outward from said central portion and tapering to a first tip, said second end portion projecting outward from said central portion diametrically opposite said first end portion and tapering to a second tip, said first longitudinal axis extending from said first tip to said second tip.

4. The package of claim 3 wherein said central portion of said base section is of a generally cylindrical shape and wherein said first end portion tapers convexly from said central portion to said first tip and said second end portion tapers convexly from said central portion to said second tip.

5. The package of claim 4 additionally comprising an outer carton, said package being arranged to be located within said carton, said carton having a wall including an opening, with portions of said wall contiguous with said opening being located within said flange recess.

6. A precursor for flexible packages for holding and selectively dispensing a liquid therefrom, each of said packages being formed of a flexible material and being arranged to be filled with the liquid and sealed on a machine and comprising a pair of open bags interconnected by an intermediate section, each of said bags comprising a respective, separate tap fitment, a first panel and a second panel juxtaposed opposite each other and fixedly secured to each other along first portions of their periphery, but unsecured along second portions of their periphery to form an open top, said tap fitment having a generally boat-shaped base section and a tap section, said base section of each respective tap fitment being interposed and sealed between said first portions of the periphery of said panels opposite said open top of its respective bag, each of said bags being arranged to be filled with the liquid through said open top and then sealed along said open top by the machine to enclose the liquid therein and thereafter separated from each other at said intermediate section to produce two separate filled bags, each with its own respective fitment.

7. The precursor of claim 6, wherein said generally boat-shaped base section has a first longitudinal axis, an opposed pair of smooth and continuous sidewalls extending along opposite sides of said first longitudinal axis, a top wall, a flange including a peripheral recess extending outward from said top wall and a first passageway extending through said base section and said flange along a second axis perpendicular to said first longitudinal axis, said base section being arranged to be located between juxtaposed portions of the periphery of said panels, said tap section comprising a second passageway extending therethrough coaxial with said first passageway and a controllable dispensing portion comprising a generally tubular member in fluid communication with said second passageway and extending along a third axis perpendicular to said second axis, said controllable dispensing portion having an outlet located at one end of said third axis, a twist cap located at the opposite end of said third axis and a valve connected to said twist cap, said twist cap being arranged to be rotated about said third axis.

8. The precursor of claim 7 wherein said generally boat-shaped base section comprises a central portion, a first end portion and a second end portion, said first end portion projecting outward from said central portion and tapering to a first tip, said second end portion projecting outward from said central portion diametrically opposite said first end portion and tapering to a second tip, said first longitudinal axis extending from said first tip to said second tip.

9. The precursor of claim 8 wherein said central portion of said base section is of a generally cylindrical shape and wherein said first end portion tapers convexly from said central portion to said first tip and said second end portion tapers convexly from said central portion to said second tip.

10. A precursor for flexible packages for holding and selectively dispensing a liquid therefrom, each of said packages being formed of a flexible material and being arranged to be filled with the liquid and sealed on a machine and comprising a pair of open bags interconnected by an intermediate section, each of said bags comprising a respective tap fitment, a first panel and a second panel juxtaposed opposite each other and fixedly secured to each other along first portions of their periphery, but unsecured along second portions of their periphery, to form an open top, said tap fitment having a generally boat-shaped base section and a tap section, said base section being interposed and sealed between said first portions of the periphery of said panels, each of said bags being arranged to be filled with the liquid through said open top and then sealed along said open top by the machine to enclose the liquid therein, said generally boat-shaped base section having a first longitudinal axis, an opposed pair of smooth and continuous sidewalls extending along opposite sides of said first longitudinal axis, a top wall, a flange including a peripheral recess extending outward from said top wall and a first passageway extending through said base section and said flange along a second axis perpendicular to said first longitudinal axis, said base section being arranged to be located between juxtaposed portions of the periphery of said panels, said tap section comprising a second passageway extending therethrough coaxial with said first passageway and a controllable dispensing portion comprising a generally tubular member in fluid communication with said second passageway and extending along a third axis perpendicular to said second axis, said controllable dispensing portion having an outlet located at one end of said third axis, a twist cap located at the opposite end of said third axis and a valve connected to said twist cap, said twist cap being arranged to be rotated about said third axis.

11. The precursor of claim 10 wherein said generally boat-shaped base section comprises a central portion, a first end portion and a second end portion, said first end portion projecting outward from said central portion and tapering to a first tip, said second end portion projecting outward from said central portion diametrically opposite said first end portion and tapering to a second tip, said first longitudinal axis extending from said first tip to said second tip.

12. The precursor of claim 11 wherein said central portion of said base section is of a generally cylindrical shape and wherein said first end portion tapers convexly from said central portion to said first tip and said second end portion tapers convexly from said central portion to said second tip.

* * * * *